United States Patent [19]

Schiel

[11] 3,946,499

[45] Mar. 30, 1976

[54] HEATED DRYER DRUM FOR PAPER MACHINES AND THE LIKE

[75] Inventor: Christian Schiel, Heidenheim-Schnaitheim, Germany

[73] Assignee: J. M. Voith, GmbH, Heidenheim (Brenz), Germany

[22] Filed: Nov. 21, 1974

[21] Appl. No.: 525,734

[30] Foreign Application Priority Data

Dec. 13, 1973 Germany ..... 2361973

[52] U.S. Cl. ..... 34/124; 165/89

[51] Int. Cl.[2] ..... F26B 25/00

[58] Field of Search ..... 34/119, 120, 121, 122, 34/124, 125; 165/89–91

[56] References Cited

UNITED STATES PATENTS

| | | | |
|---|---|---|---|
| 2,166,245 | 7/1939 | Goff et al. | 34/125 |
| 2,328,321 | 8/1943 | Berry | 34/124 |
| 2,542,287 | 2/1951 | Neubauer | 34/124 |
| 2,576,036 | 11/1951 | Ostertag et al. | 165/89 |
| 2,879,039 | 3/1959 | Skinner | 34/124 |

*Primary Examiner*—Kenneth W. Sprague
*Assistant Examiner*—James C. Yeung
*Attorney, Agent, or Firm*—Melvin A. Crosby

[57] ABSTRACT

A heated dryer drum consisting of a peripherally closed cylindrical shell with dryer heads engaging the shell at opposite ends thereof and each comprising a central bearing journal for rotatably supporting the drum. Included inside the drum is at least one tie rod extending between and connected to the dryer heads near the centers thereof. The dryer heads are axially resilient and preloading of the tie rod, or tie rods, preloads the dryer shell. The dryer heads advantageously taper in thickness from a thicker hub portion to a thinner peripheral portion, with the peripheral portion engaging opposite ends of the dryer shell. The tie rod, or tie rods, may be heated during installation so that, upon cooling, a desired preload will be imparted to the dryer shell. Furthermore, spring means can be incorporated in the tie rod, or tie rods, for controlling the preload on the dryer shell. Still further, measuring means may be incorporated in the tie rod, or tie rods, so that the degree of preload thereon can readily be observed.

16 Claims, 6 Drawing Figures

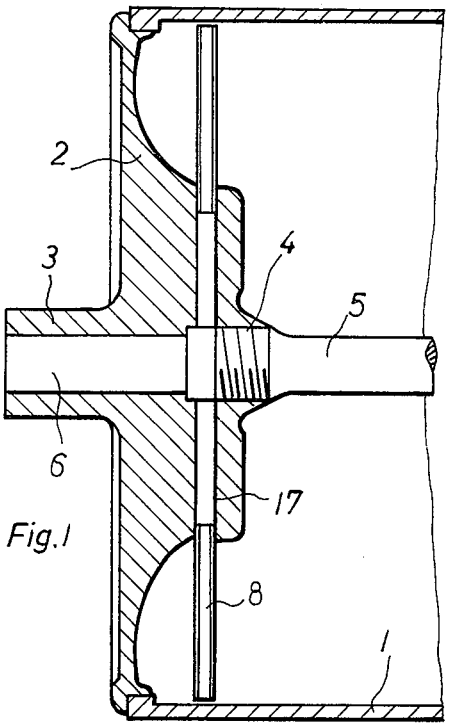
Fig.1
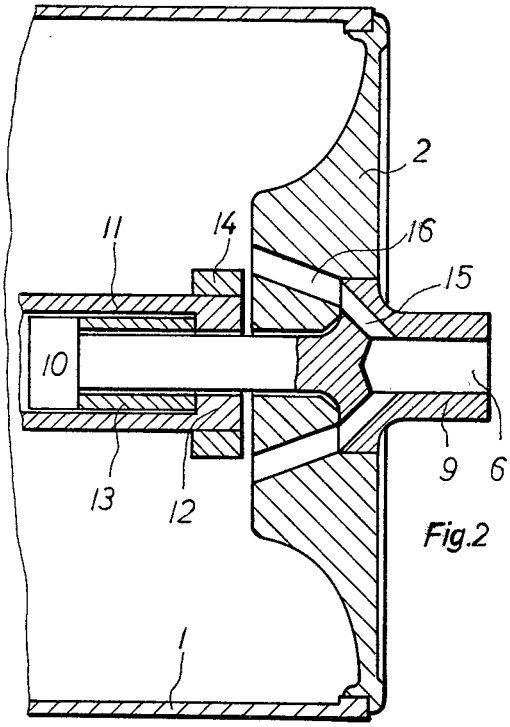
Fig.2
Fig.3
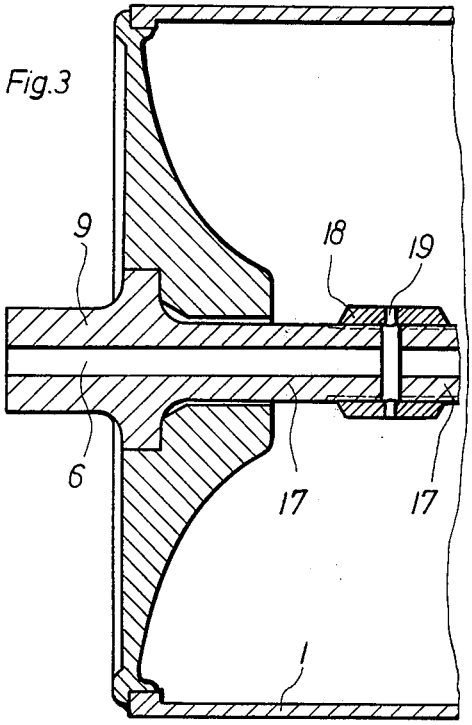
Fig.4
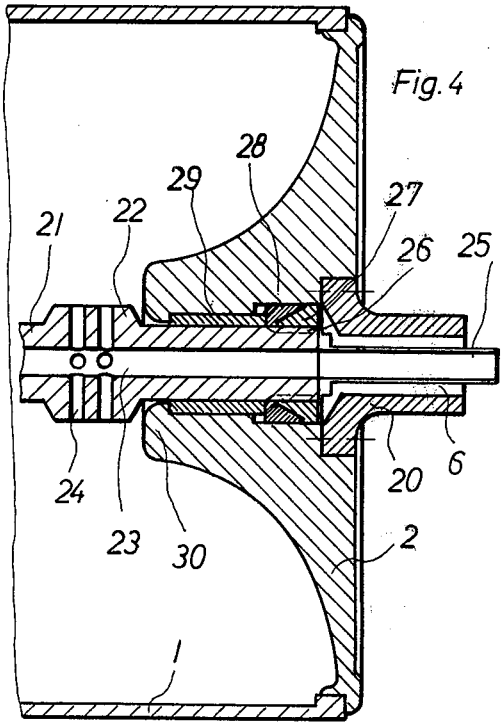

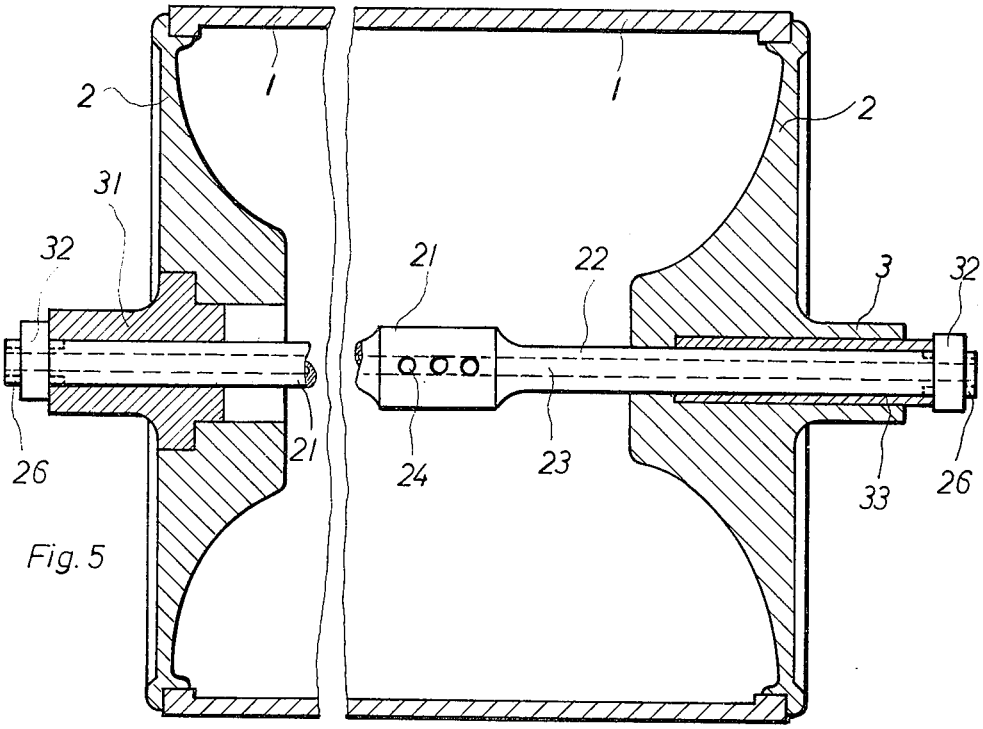
Fig. 5
Fig. 6
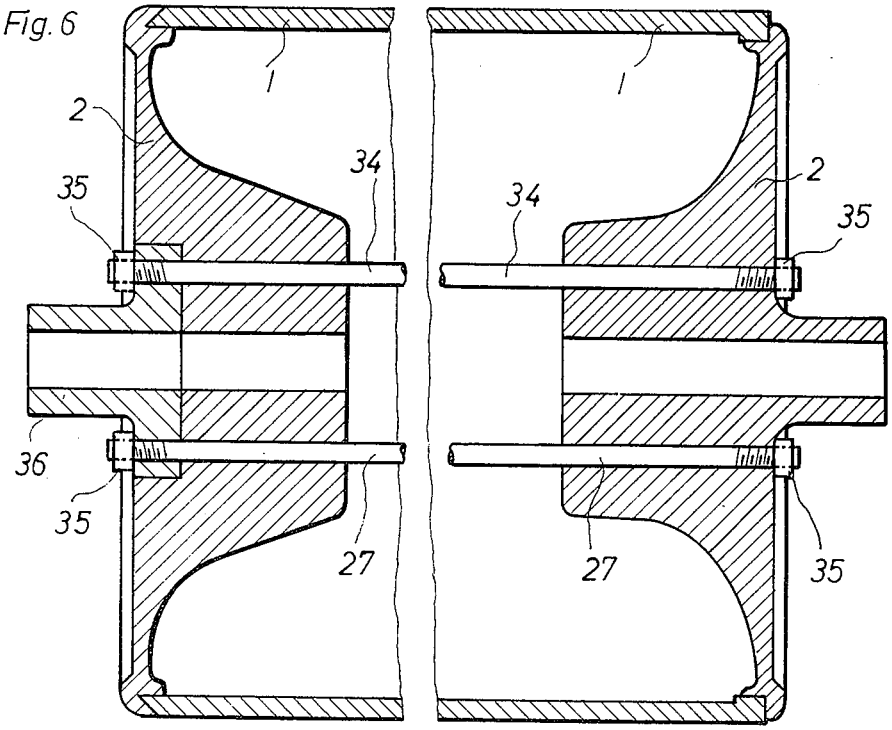

HEATED DRYER DRUM FOR PAPER MACHINES AND THE LIKE

The present invention relates to a heated dryer drum for paper machines and the like having a dryer shell of closed peripheral surface, as well as dryer heads, to which are connected the bearing journals.

With the majority of dryers known in practice the dryer heads are connected to the dryer shell by a plurality of circumferentially distributed bolts, and for this purpose, the shell is fitted on both ends with a torus, usually integral with the shell, which the bolts engage.

For relieving the load acting on the bolt connections, especially on large dryers, the dryer incorporates a central hollow shaft engaging the end members and absorbing from a quarter up to about a half of the internal pressure acting in the axial direction. However, during operation, the paper sheet, or web, entrained over the drum strongly cool down the dryer shell so that the shell tends to shorten in length relative to the hollow shaft. Thus, the pressure component to be absorbed by the dryer shell grows quite considerably.

The tori of the dryer shell have to be comparatively thick in order to be capable of accommodating the head connecting bolts and of transmitting the bolt forces to the shell. Dryers having such thick tori are comparatively difficult to cast; and, the plurality of bolt holes that must be formed therein involves high machining expenses.

For the purpose of increased drying efficiency the interior of the dryer shells may be provided with peripheral grooves producing a notch effect which in view of the high tensile stresses in the dryer shell can result in cracks in the shell which, in turn, may cause the dryer drum to explode.

The main object of the invention is to create an operationally safe dryer of high thermal efficiency so that the above mentioned disadvantages are avoided.

According to an embodiment of the invention this problem is solved in that the interior of the dryer is fitted with tie rods for the absorption of axial tensile stresses, said tie rods in the range of the axis of rotation of the dryer being connected to the dryer heads attacking the dryer shell under the action of preload, the dryer heads being designed as disc springs, in the range of their hubs the thickness being approximately four times their peripheral range or more, the change in thickness taking place continuously.

In this way it is ensured that, without using additional fastening elements, the dryer heads seal off the dryer shell so that the dryer shell can be substantially isolated from axial tensile stresses. In this case, the tie rod may be designed as a rigid component which subjects the shell to such a compressive preload that the dryer shell, while cooling down and dissipating heat, is not shortened in length relative to the tie rod but only the axial preload is reduced.

A very advantageous improvement of the invention consists in the possibility of using a plurality of tie rods disposed about the axis of rotation of the dryer. However, another useful development of the invention provides for the use of a central tie rod the longitudinal axis of which coincides with the axis of rotation of the dryer. Such a tie rod is especially simple to mount inside the dryer.

According to the invention, the tie rod incorporates a device for adjustment of the preload. This device may be a simple threaded nut which is tightened more firmly for the adjustment of a higher preload. If the dryer drum is fitted with a central tie rod, the tie rod according to the invention may have at least an axial bore for the supply of steam and the removal of condensate. In this case, the tie rod will preferably have a zone of enlarged cross section in which are arranged openings communicating between the axial bore and the interior of the dryer.

In order to be able to measure the stresses in the tie rods, a very advantageous improvement of the present invention consists in using axial measuring rods which, consisting of the same material as the tie rods, have the same thermal expansion.

For the assembly of the dryer it is advantageous if, according to another embodiment of the present invention, the tie rods are equipped with a heating device. The possibility of heating the tie rods produces an expansion which, upon cooling down, preloads the tie rods without the need of additional loading devices.

These and other objects and advantages of the present invention will become more apparent upon reference to the following detailed specification taken in connection with the accompanying drawings, in which:

FIGS. 1 to 5 show five different embodiments of dryers having central tie rods.

FIG. 6 shows a dryer having a plurality of tie rods arranged in the vicinity of the axis of rotation of the dryer.

BRIEF SUMMARY OF THE INVENTION

According to the present invention, a dryer drum is provided having a peripherally closed cylindrical shell. Abuttingly engaging each end of the shell is a head member or end member and carried by the dryer heads, or end members, are journals, which may be in the form of shaft members, so that the dryer drum can be rotatably supported on the central axis thereof. Each head varies in thickness from a thinner peripheral portion which engages the respective end of the shell to a thicker central portion where the journal members are located.

According to the present invention, the heads are interconnected by one or more tie rods which are prestressed so that the dryer shell is also prestressed. The shell is, thus, freed of stresses which reverse as the temperature of the shell of the dryer drum varies. The dryer shell, accordingly, always remains in axial compression according to the present invention.

DETAILED DESCRIPTION OF THE INVENTION

The dryer shown in FIG. 1 incorporates a dryer shell 1, both edges of which have a relatively small inwardly protruding torus 1'. Engaging torus 1' is the periphery of a dryer head 2 having an integrally formed bearing journal 3. The dryer head 2 has a comparatively thick central section which, representing the hub, thins out toward the peripheral rim.

The thickness of the hub is four times or more the thickness of the head at the peripheral rim. The side of the dryer head 2 facing the interior of the dryer is provided with a central threaded bore 4 into which is threaded a central tie rod interconnecting the two dryer heads.

Bearing journal 3 is provided with an axial bore. The axial bore in the journal for the dryer head, which is not shown in FIG. 1, serves for the introduction of steam into the dryer. The axial bore in the dryer head shown in FIG. 1 facilitates removal of condensate for which purpose it communicates with radial bores 7 in the dryer head 2 to which are connected suction tubes 8. The opposite ends of the tie rod 5 may be oppositely threaded, or may have threads of different pitch so that rotation of the tie rod 5 in one direction will impose an axial prelaod on the dryer heads and, therethrough to the shell 1.

The embodiment according to FIG. 2 shows a dryer head 2 with an inserted bearing journal 9 which at the same time acts as part of the tie rod of the dryer. Formed on the bearing journal 9 for this purpose is a rod-like extension protruding into the dryer interior, said extension carrying a thickened head 10 at its end inside the dryer. The head 10 and part of the extension are situated in a tube 11 consisting of two half shells, the end of the head facing the dryer head 2 carrying a radially inwardly protruding collar 12. Clamped between collar 12 and head 10 is a pressure sleeve 13, which is also axially split. The tube 11 is held together by clamping rings 14 (only one being shown). Provided in bearing journal 9 are bores 15 leading to dryer head 2, said bores extending from the axial bore 6 in journal 9 to bores 16 in the dryer head. The bores 16 lead into the interior of the dryer and facilitate the introduction of steam into the dryer. The tie rod is adjustably connected to the other dryer head, as in the FIG. 1 modification, and is coupled in any suitable manner to tube 11 so the dryer heads can be preloaded as explained in connection with the FIG. 1 modification.

The embodiment according to FIG. 3 again shows a bearing journal 9 inserted into dryer head 2, said bearing journal having tie rod 17 portion protruding axially into the interior of the dryer. The other dryer head may have a similar journal member with a corresponding axial tie rod portion 17'. The two tie rod portions 17, 17' formed on the two bearing journals of the dryer are interconnected by a clamping nut, or coupler, 18. The two tie rods are spaced at short distance from each other at the opposed ends so that steam entering the axial bore 6 can escape from the gap and enter the interior of the dryer through bores 19 in clamping nut, or coupler, 18. In the same manner may also condensate be removed from the dryer.

The embodiment according to FIG. 4 shows a bearing journal, or shaft member, 20 bolted on dryer head 2. The two dryer head (one not shown) are connected by a one-piece tie rod 21 which in the zone lying between its two dryer heads has a region 22 of enlarged cross section. The tie rod 21 is provided with an axial bore 23 which facilitates the supply of steam to the dryer. A further bore in the tie rod may be provided for the removal of condensate. Arranged in section 22 of tie rod 21 are radial bores 24 which communicate with the axial bore 6 and the interior of the dryer. Fitted at the end of tie rod 21 is an extension tube 25 for the axial bore 23 which protrudes through the axial bore 6 of bearing journal 20. The end of tie rod 21 is fitted with a male thread 26 screwed on, which is a threaded ring 27 which tapers inwardly toward the interior of the dryer. Resting on this tapering section is another ring 28 which the threaded ring 27 forces against an elastic pressure sleeve 29. The pressure sleeve with its other end rests on a shoulder 30 of dryer head 2. The dryers shown in FIGS. 1 through 4 may be of the same design on both sides. However, it is also possible to use different configurations for both sides.

Such an embodiment is shown in FIG. 5. The tie rod 21 shown in FIG. 5 generally corresponds to that shown in FIG. 4, except that both ends of the rod are provided with a male thread 26, and protrude through the bearing journals. The bearing journal 20 shown at the left of FIG. 5 resembles the bearing journal 20 in FIG. 4; however, a nut 32 screwed on the male thread 26 forces the bearing journal against dryer head 2. Provided on the other side is also a nut 32 which, however, presses against a sleeve 33 that, in turn, rests on the bottom of a bore formed in bearing journal 3 integrally formed on the dryer head like the one shown in FIG. 1.

The embodiment according to FIG. 6 is an arrangement of several tie rods 34 distributed about the axis of rotation of the dryer drum and only two of which are shown. The ends of these tie rods are provided with a thread screwed on which is a nut 35 each. According to the embodiment shown at the right, these nuts 35 directly rest against dryer head 2 integrally formed on which is bearing journal 3.

With the embodiment shown at the left, the bearing journal 36 is inserted into the dryer head and pressed against dryer head 2 by the nuts 35 attacking it. According to this embodiment, also the joint between dryer head 2 and dryer shell 1 slightly differs in that the dryer shell has a chamfered peripheral section which engages in a peripheral undercut on the rim of the shell 1 of the dryer drum.

The tie rods of any of the embodiments may be provided with an axial bore incorporating a measuring rod consisting of the same material as the tie rod. This measuring rod is fixed at one end to one end of the rod and is freely movable in the axial direction at the other end. If the free end is fitted with a graduated scale, the tensile stress in the tie rod can be read off directly. It is also possible to arrange such a measuring rod directly beside the tie rod.

Modifications may be made within the scope of the appended claims.

What is claimed is:

1. A heated dryer drum, especially for a paper machine comprising; a closed cylindrical shell, end members connected to opposite ends of said shell, each end member engaging the axial end surface and the radially inner surface of the respective end of the cylindrical shell, journal means connected to said end members in the center and projecting axially outwardly therefrom for rotatably supporting said drum, and tie rod means inside said shell extending axially between and engaging said end members near the centers of the end members, said tie rod means adapted for being placed in tension thereby to draw said end members into prestressed load transmitting relation with said shell, said end members being axially resilient, each said end member gradually increasing in thickness in the radially inward direction, and being about four times as thick in the axial direction in the center as it is near the periphery, said tie rod means engaging said end members in the axially thickest regions thereof.

2. A heated dryer drum according to claim 1 in which said tie rod means comprises a plurality of tie rods distributed about the axis of rotation of the drum.

3. A heated dryer drum according to claim 1 in which said tie rod means comprises at least one tie rod on the axis of rotation of the drum.

4. A heated dryer drum according to claim 1 in which said tie rod means incorporate spring means therein.

5. A heated dryer drum according to claim 1 in which said tie rod means includes adjusting means incorporated therein for adjusting the tension on said tie rod means.

6. A heated dryer drum according to claim 1 in which said tie rod means includes axial first passage means therein communicating with the outside of the drum and radial second passage means leading from said first passage means into the interior of said shell.

7. A heated dryer drum according to claim 3 in which said drum is internally heated, and said one tie rod includes axial first passage means communicating at one end with the outside of the drum, and second passage means in said one tie rod leading from said first passage means into the interior of said drum.

8. A heated dryer drum according to claim 7 in which said one tie rod has at least one enlarged diameter region thereon inside said drum, said second passage means being disposed in said enlarged diameter region.

9. A heated dryer drum according to claim 1 which includes at least one measuring rod parallel to and adjacent a respective tie rod and substantially axially coextensive therewith, said measuring rod being made of the same material as the tie rod, said measuring rod having one end connected to the adjacent end of the tie rod and comprising graduation means at the other end.

10. A heated dryer drum according to claim 1 which includes means for heating said tie rod means during installation on adjustment thereof for assisting in imparting a desired preload thereto.

11. A heated dryer drum according to claim 1 in which said journal means comprises a shaft member at one end of the drum having a flange engaging the respective end member on the outer side and having a rod-like portion extending axially through the respective end member to the inside of the drum, an enlarged inner end on said rodlike portion, a central tie rod member in the drum having one end threadedly engaging the other end member and extending toward said rod-like portion, and means coupling the other end of said tie rod member to said enlarged inner end of said rod-like portion.

12. A heated dryer drum according to claim 11 which includes steam inlet passage means in said shaft member and the respective end member, condensate withdrawl means comprising an axial bore in said other end member, and radial tube means carried by said other end member and having one end near the inner periphery of said shell and the other end in communication with said axial bore.

13. A heated dryer drum according to claim 1 in which said journal means comprises shaft means protruding outwardly from said end members and having flanges engaging said end members on the axially outer sides, said tie rod means comprising rod-like extensions on said shaft means extending axially into said drum and threaded on the ends, said threaded ends being axially spaced from one another, and a coupling member threaded on said rod ends.

14. A heated dryer drum according to claim 13 in which at least one of said rod-like extensions is formed with an axial passage, and said coupling member having radial passages therein connecting said axial passage with the inside of said shell.

15. A heated dryer drum according to claim 3 in which at least one end member has a shouldered socket formed therein from the outside and into which the adjacent end of said tie rod extends, a nut in the socket threaded on the end of said tie rod, a compression member interposed between the nut and the bottom of the socket in the respective end member, said journal means for said one end member comprising a tubular member seated in the axially outer portion of said socket, passage means formed in said tie rod and leading from at least the end of the tie rod into the inside of said shell, and conduit means extending axially through said tubular member and communicating with said passage.

16. A heated dryer drum according to claim 3 in which at least one end member has a shouldered socket formed therein from the outside and through which the adjacent end of said tie rod extends, said journal means for said one end member comprising a shaft member having a flange seated in said socket and a bore through which said tie rod extends, and a nut threaded on the end of said tie rod and engaging the axially outer end of said shaft member.

* * * * *